US007222451B2

(12) United States Patent
Keng et al.

(10) Patent No.: US 7,222,451 B2
(45) Date of Patent: May 29, 2007

(54) QUICK DISCONNECT BIPOD MOUNT AND CLAMP ASSEMBLY

(76) Inventors: Da Keng, 875 Wharton Dr. SW., Atlanta, GA (US) 30336; Maciej W. Matuszczak, 505 Bluff Ct., Woodstock, GA (US) 30188

( * ) Notice: Subject to any disclaimer, the term of this patent is extended or adjusted under 35 U.S.C. 154(b) by 95 days.

(21) Appl. No.: 11/055,997

(22) Filed: Feb. 14, 2005

(65) Prior Publication Data

US 2005/0188597 A1 Sep. 1, 2005

Related U.S. Application Data

(60) Provisional application No. 60/543,572, filed on Feb. 12, 2004.

(51) Int. Cl.
*F41A 23/08* (2006.01)
*F41C 21/00* (2006.01)

(52) U.S. Cl. ..... 42/94; 89/37.04; 42/127

(58) Field of Classification Search ..... 42/94, 42/124, 127; 89/37.04; 211/64; 248/171, 248/440.1

See application file for complete search history.

(56) References Cited

U.S. PATENT DOCUMENTS 271,251 A * 1/1883 Leerbech et al. ..... 42/94
2,420,267 A * 5/1947 Sefried ..... 42/94
2,436,349 A * 2/1948 Adams ..... 42/94
2,489,283 A * 11/1949 Garand ..... 42/94
3,327,422 A * 6/1967 Harris ..... 42/94
4,017,997 A * 4/1977 Peterson et al. ..... 42/94
6,785,997 B2 * 9/2004 Oz ..... 42/94
6,829,857 B1 * 12/2004 Houtsma ..... 42/94
7,111,424 B1 * 9/2006 Moody et al. ..... 42/72
2001/0022044 A1 * 9/2001 Spinner ..... 42/124

* cited by examiner

*Primary Examiner*—Michael J. Carone
*Assistant Examiner*—Bret Hayes
(74) *Attorney, Agent, or Firm*—Jones, Tullar & Cooper, PC

(57) ABSTRACT

A quick disconnect clamping assembly for releaseably attaching an accessory such as a bipod to an elongate support such as a picatinny-style mounting rail comprises a clamp body with a mounting yoke that is adapted to slide over and receive the picatinny rail. The yoke includes a substantially rectangular base plate defining the central upper surface of a clamp body and includes a pair of parallel sidewalls extending upwardly therefrom. The base plate has, in one embodiment, first and second transverse bores for first and second substantially rectangular upwardly movable bolts actuable to project upwardly from the yoke base plate. The clamp body's first and second transverse bolts, when raised and aligned with the transverse grooves of the picatinny rail, are received in the spaced transverse grooves of the rail to attach the yoke to the rail.

10 Claims, 10 Drawing Sheets

QUICK DISCONNECT BIPOD MOUNT AND CLAMP ASSEMBLY

RELATED PATENT AND PENDING PATENT APPLICATION INFORMATION

This application claims priority to provisional patent application No. 60/543,572, filed Feb. 12, 2004, the entire disclosure of which is incorporated herein by reference. This application is owned by the applicant/owner of U.S. Pat. No. 5,711,103 and U.S. Pat. No. 5,815,974, the entire disclosures of which are incorporated herein by reference. Additionally, this application is owned by the applicant/owner of provisional application No. 60/338,153, filed Nov. 13, 2001, the entire disclosure of which is also incorporated herein by reference.

BACKGROUND OF THE INVENTION

1. Field of the Invention

The present invention relates to an apparatus and method useful as firearm accessories and support devices such as bipods, and more particularly, relates to a clamp assembly for attaching an accessory to a mounting rail structure affixed to the forearm stock of a firearm. The clamp assembly attaches to the rail structure and enables quick attachment and detachment of the accessory to the firearm without modification of the rail structure or forearm stock of the firearm.

2. Background of the Invention

When shooting firearms, especially in stressful tactical situations, it is important that the firearm be maintained in a steady, stable position to insure accuracy of aim. Most shooters are not able to hold a firearm consistently in a set position without wavering, especially after the onset of fatigue resulting from strain on the shooter due to the size and weight of the firearm.

Accordingly, peripheral support devices have been used in conjunction with firearms since the early creation of firearms as a means of stabilizing a firearm to reduce vibration, wavering, etc., and to improve accuracy.

In the past, shooters have used everything from large stationary objects such as rocks and tree branches to forked sticks, shooting slings, bipods and tripods. Early bipod and tripod supports typically were somewhat crude strands that generally were bulky, inconvenient and difficult to use and typically were not easily adjustable. In more recent times, bipod supports have been developed that are compact and relatively lightweight and are mountable to the forearm stock of a firearm, such as a rifle, to make the bipods portable with the firearm. Most conventional bipod supports include a pair of legs that can be pivoted from an up position adjacent the firearm stock, to a down position engaging a support surface, with the legs also being extensible to adjust the height of the support.

A problem with conventional bipods has been the ability of the bipod to mount to most firearms without requiring the use of special mounting tools and the machining or modification of the firearm stock to accommodate the bipod. Additionally, most bipods are not designed for quick and easy attachment and release of the bipod from the firearm stock. For example, U.S. Pat. No. 5,194,678 discloses a bipod assembly that includes legs that are pivotable independently of one another for ease of adjustment, but which is not easily attached/detached from the firearm. Other types of conventional bipods offer varying types of mountings that can be fitted to various types of rifles without requiring modification or machining of the rifle stock. Harris Engineering, Inc. manufactures a series of bipod mounts for use with a variety of different firearms. However, these bipod mounts do not provide for the quickly releasing an attached bipod support from the firearm.

One of the most popular bipods on the market has been the Parker-Hale bipod assembly. This bipod includes a pair of telescoping legs attached to a mounting frame, and a mounting block for mounting the bipod to the firearm. The mounting block of the Parker-Hale bipod is releasably attached to the mounting frame of the bipod to enable quick attachment/release of the legs of the bipod from the firearm. The problem with the Parker-Hale bipod is that to mount the bipod to a firearm, the forearm stock of the firearm generally must be modified to mount a track or slide therein, along which the mounting block is received to mount the bipod to the firearm. Such modifications generally are expensive and often must be done by specialty gunsmiths and can mar the finish of the firearm.

Military or police shooters using military or SWAT rifles often carrying special mounts known as MIL-STD-1913 "picatinny" rails under the rifle forearm; the picatinny rails are customarily used for mounting grenade launchers, lights or other accessories and so the rifles often weigh much more than the lighter sporting arms most shooters are used to carrying. Clamping objects to forearm mounted picatinny rails is usually a lengthy, cumbersome process requiring that the shooter juggle small parts in the field.

Accordingly, it can be seen that a need exists for a bipod mounting device for selectively attaching a bipod to a firearm adapted for use in military or SWAT situations, where the shooter may choose, for precision aiming, to have a stable support. Ideally, the attachment should not require extensive modification to the firearm such as machining of the forearm stock of the firearm. Preferably, a mounting device would also enable quick and easy attachment and detachment of the bipod (or other accessory) to the firearm.

SUMMARY OF THE INVENTION

The present invention comprises a mounting clamp assembly for mounting an accessory such as a bipod support to a mounting rail structure as are often affixed below the forearm stock of a firearm such as a military rifle. In an illustrative embodiment, the present invention is directed to use for mounting a Parker-Hale style of firearm bipod of the type including a mounting block with an integral clamp assembly to cover and attach to a picatinny rail affixed beneath the forearm stock of the firearm. The mounting block is releasably attachable to a bipod mounting frame by means of a transverse bolt or a similar fastening means. The bipod mounting frame includes a pair of extensible/retractable legs, each having a pair of telescoping sections to enable the height of the bipod to be adjustable as desired.

The bipod mounting device of the present invention generally comprises a clamp body with a mounting yoke that is adapted to slide over and receive the picatinny rail. The yoke is releaseably affixed to and hangs from the picatinny rail. The yoke includes a substantially rectangular base plate defining the central upper surface of a clamp body and includes a pair of parallel sidewalls extending upwardly therefrom. The base plate is a substantially flat plate having, in one embodiment, first and second rectangular elongate transverse openings or bores formed across the centerline of the rectangular base plate's central upper surface. In a preferred embodiment, first and second substantially rectangular upwardly movable bolts are slidably disposed within the first and second rectangular elongate transverse openings in the rectangular base plate's central upper surface and are controllable or actuable to project upwardly from the yoke base plate's central upper surface.

The yoke base plate sidewalls include inwardly facing v-shaped grooves and are spaced apart; the sidewalls are adapted to fit about and straddle the sides of the picatinny rail mounted to the forearm stock of the firearm, with the length of the rail being received between the side walls. The picatinny rail is a standard element of the military firearm and normally is used for attaching a variety of accessories including lights, grenade launchers and other devices. The clamp body's first and second transverse bolts, when raised and aligned with the transverse grooves of the picatinny rail, are received in the spaced transverse grooves of the rail to attach the yoke to the rail.

The bolts are actuated by turning an elongate control screw keyed to turn first and second eccentric rotating cam members within the clamp body and beneath the first and second bolts. Each cam preferably bears on a cam-following spring retaining block which includes first and second vertical through bores containing first and second biasing coil springs. Each bolt is preferably configured as a J shaped member with the cam and spring retaining block disposed within the interior contour of the bolt, such that the cam and spring retaining block can be rotated to urge the cam into an upwardly projecting position, or can be rotated into a position tending to force the bolt downwardly, to lower the bolt such that it does not project above the yoke base plate's central upper surface.

In use, the bolts are initially in the retracted position, such that neither bolt projects above the yoke base plate's central upper surface. Next, the shooter slides the clamp assembly's yoke over the picatinny rail of the firearm and places the clamp assembly in a selected aligned fore/aft position. Next, the clamp body's first and second transverse bolts are raised and are received in and constrained by the spaced transverse grooves of the rail to fixedly attach the yoke to the rail.

The resulting attachment of the clamp assembly to the forearm stock provides a quick and easy attachment of the bipod (or some other accessory) to the firearm and enables the clamp assembly to mount securely to the forearm stock of the firearm in a stable, secure selected position. This prevents the clamp assembly, and thus the accessory carried by the clamp (e.g., a bipod), from shifting fore and aft or wobbling during use.

With the clamp assembly securely mounted to the forearm stock of the firearm, the attached accessory (e.g., a bipod frame) is placed in locking engagement with the firearm. Optionally, a detachable sling loop can be provided with the clamp assembly for attachment of a rifle sling to the stock of the firearm.

Various objects, features and advantages of the present invention will become apparent to one skilled in the art upon a review of the following specification, when taken in conjunction with the accompanying drawings.

DETAILED DESCRIPTION OF A PREFERRED EMBODIMENT

Referring now to FIGS. 1*a*-10 in which like numerals indicate like parts throughout the several views, the present invention comprises a clamp assembly 10 for mounting an accessory or support such as a bipod 12 to a firearm or other device or instrument. The clamp assembly 10 is generally is mounted to the forearm stock portion of the firearm via an elongate weaver style or picatinny arsenal style elongate mounting rail 50 as typically affixed below and carried on the front end of a rifle's forearm stock.

Figure 10:
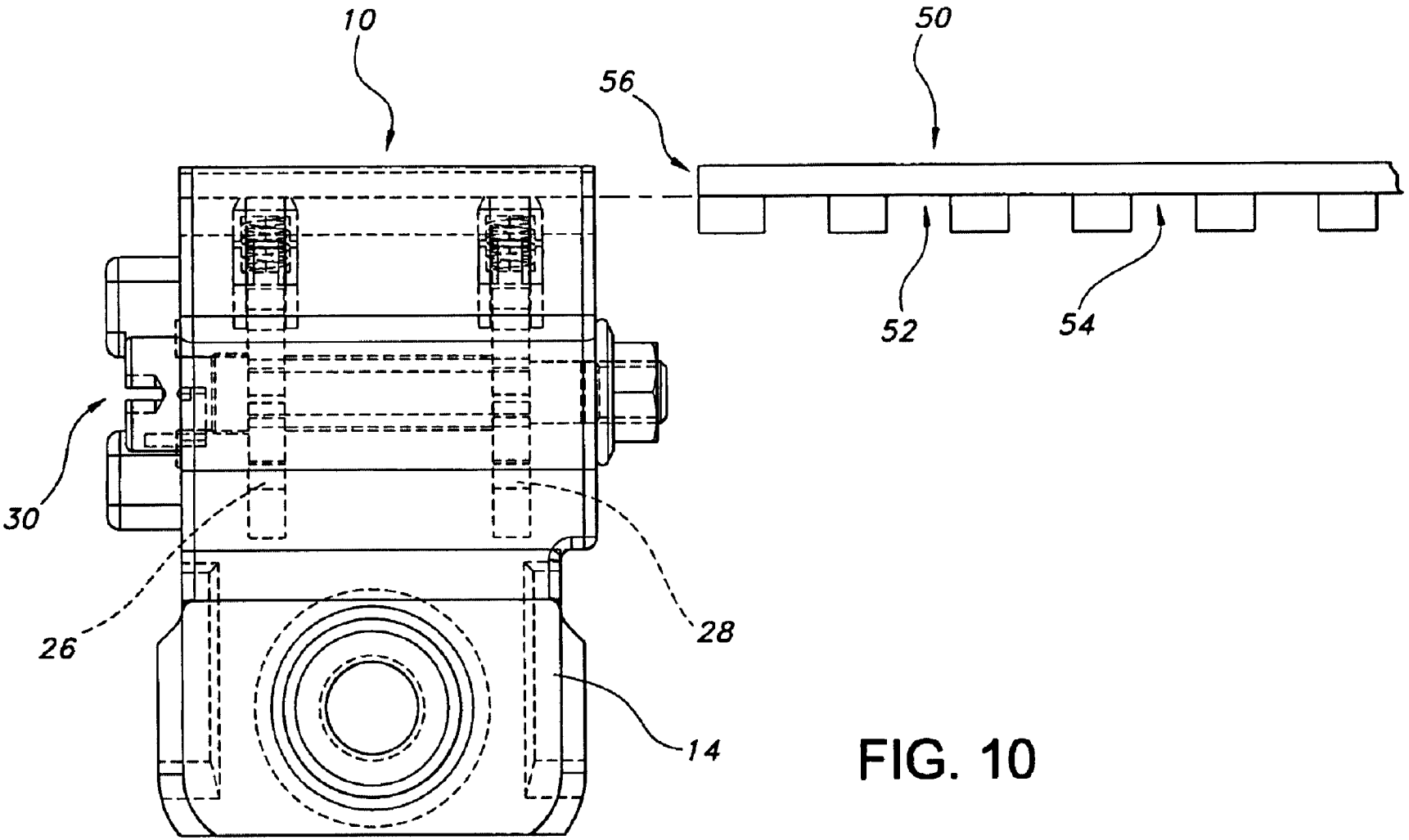
FIG. 10 illustrates the clamp assembly with the first and second bolts in the retracted, down, unlocked or open position, and aligned for sliding over the free end of a mounting rail, in accordance with the present invention.

Mounting rail 50 can be any suitably strong and rigid elongate supporting structure but, in the above described illustrative embodiment, is a picatinny rail mounting structure (i.e., a MIL-STD-1913 picatinny rail) having a plurality of evenly spaced standard size transverse grooves (e.g., 50, 54, as best seen in FIG. 10). Mounting rail 50 is preferably aligned in parallel with an instrument's operational axis (e.g., such as the central axis of a firearm's barrel), and terminates proximally in a proximal end and terminates distally in a distal end 56.

As the Figures illustrate, the bipod 12 has first extendable leg 60 and second extendable leg 62 as described in co-owned U.S. Pat. Nos. 5,711,103 and 5,815,974, the entire disclosures of which are incorporated herein by reference.

As noted above, the present invention comprises a clamp assembly 10 for mounting an accessory support to a mounting rail structure. In the illustrated embodiment, the present invention is directed to use for mounting a Parker-Hale style of firearm bipod of the type including a mounting block with an integral clamp assembly to cover and attach to a picatinny rail affixed beneath the forearm stock of the firearm. The mounting block or clamp body is releasably attachable to an accessory such as bipod mounting frame 12 by means of a transverse bolt or a similar fastening means (as shown in FIGS. 7*a*-7*d* and FIG. 8). The bipod mounting frame preferably includes a pair of extensible/retractable legs, each having a pair of telescoping sections to enable the height of the bipod to be adjustable as desired.

Figure 6:
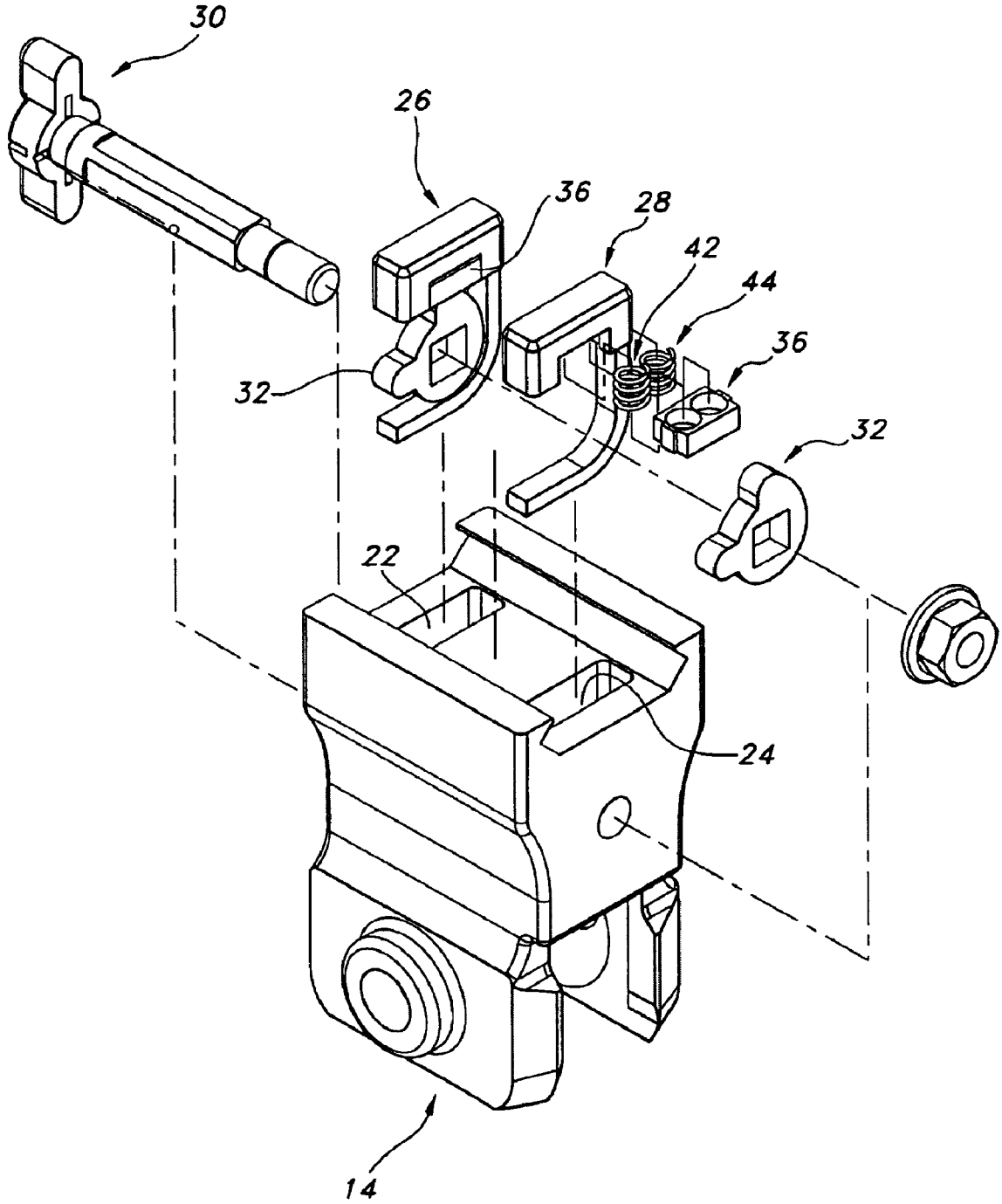
FIG. 6 is an exploded perspective view, in elevation, of the clamp assembly of FIGS. 1*a*-1*d*, in accordance with the present invention.

The accessory mounting device of the present invention generally comprises a clamp body 10 with a body or mounting yoke 14 that is adapted to slide over and receive the opposing V shaped sides of picatinny rail 50. The yoke 14 is releaseably affixed to and hangs from rail 50. The yoke includes a substantially rectangular base plate surface 16 defining the central upper surface of a clamp body and includes a pair of parallel sidewalls 18, 20 extending upwardly therefrom. The base plate 16 is a substantially flat plate-like surface having, in one embodiment, first and second rectangular elongate transverse openings or bores 22, 24 formed across the centerline of the rectangular base plate's central upper surface (as best seen in FIG. 6). In a preferred embodiment, first and second substantially identical rectangular upwardly movable bolts 26, 28 are slidably disposed within first and second substantially identical rectangular elongate transverse openings 22, 24 in the rectangular base plate's central upper surface 16 and are controllable or actuable to project upwardly from the yoke base plate's central upper surface (as shown in FIGS. 1*a*-1*d* and 8).

The yoke base plate sidewalls 18, 20 include inwardly facing V-shaped grooves and are spaced apart; the sidewalls are adapted to slidably retain and straddle the V shaped sides of the picatinny rail mounted to the forearm stock of the firearm, with the length of the rail being received between the side walls. Mounting picatinny rail 50 is a standard element of the military firearm and normally is used for attaching a variety of accessories including lights, grenade launchers and other devices. The clamp body's first and second transverse bolts 26, 28, when raised and aligned with the transverse grooves 52, 54 of the picatinny rail, are received in the spaced or alternate (e.g., third and fifth, counting from distal end 56) transverse grooves of the rail to affix yoke 14 to the rail, and in the embodiment illustrated, engage alternate rail grooves, leaving one rail groove not engaged between the bolts 26, 28. The applicant has discovered that having a long clamping surface and engaging spaced apart grooves (e.g., 52, 54) provides a more stable clamping action, and more reliable locking and unlocking, when used in harsh environments.

Bolts 26, 28 are actuated by turning an elongate control screw 30 around its own central axis. Control screw is keyed to turn first and second substantially identical eccentric rotating cam members 32 within the clamp body and beneath the first and second bolts 26, 28 (as best seen in the exploded view of FIG. 6).

Figure 5B:
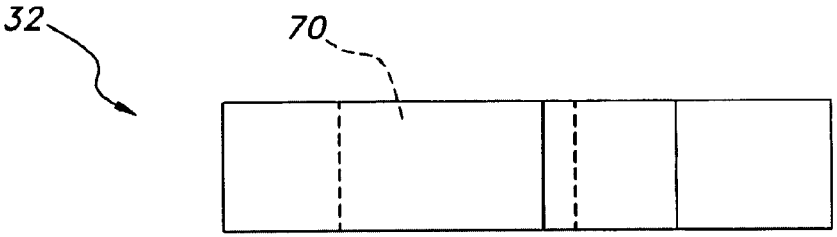
FIGS. 5*a*-5*c* illustrate an eccentric cam from the clamp assembly of FIGS. 1*a*-1*d*, in accordance with the present invention.
Figure 5C:
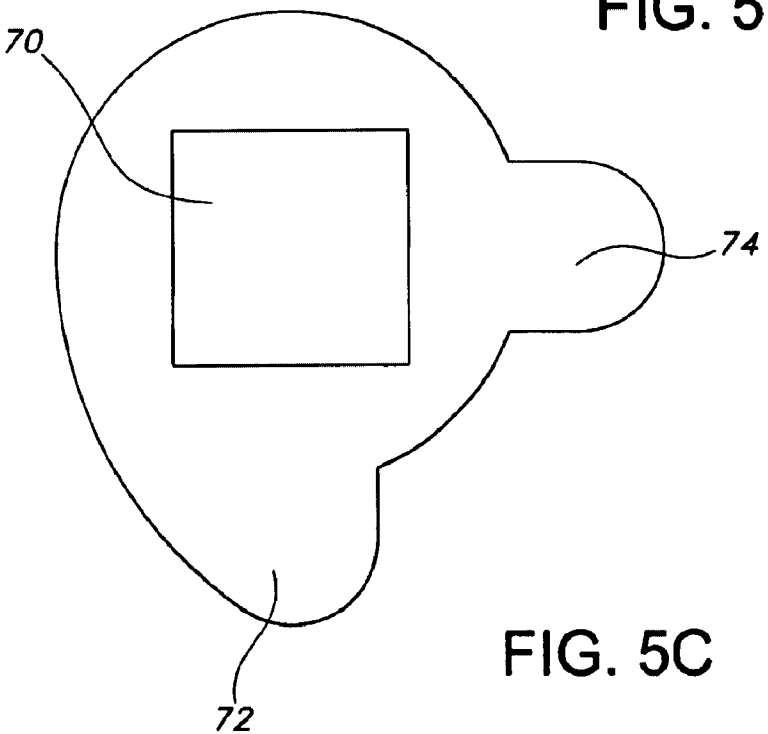
Figure 5A:
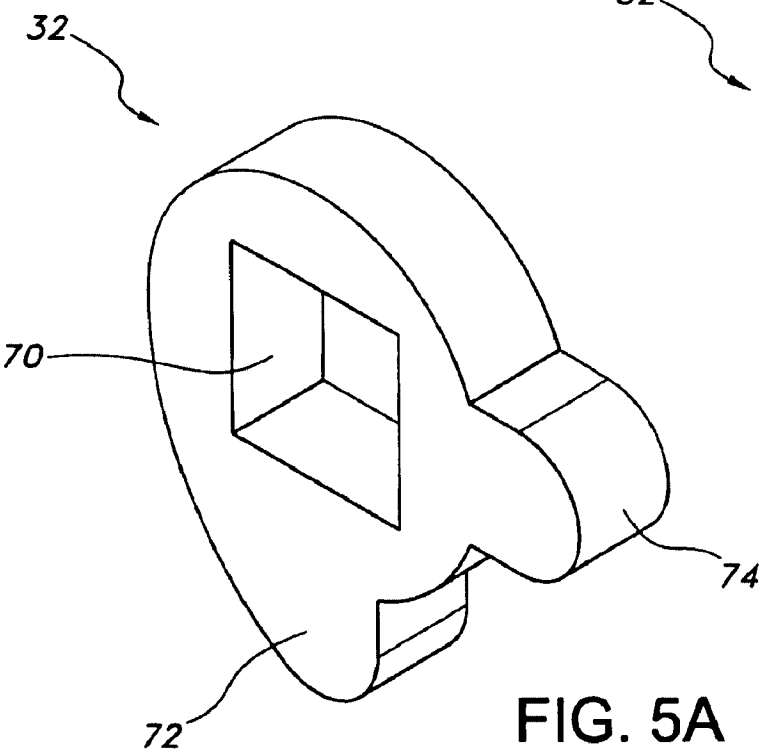

Referring now to FIG. 5, each cam 32 has at least one and preferably two cam lobes. In the embodiment illustrated, each cam 32 has a central key hole 70 dimensioned to closely fit onto the peripheral shape of the shaft of control screw 30, and is in the illustrated embodiment, shaped as a 5.5 mm square. In the exemplary embodiment, a first cam lobe 72 is arrayed at approximately ninety degrees from a second cam lobe 74, where both lobes provide a cam lobe lift of approximately 3.25 mm. First cam lobe 72 has a longer duration, gradually ramping up from a nominal radius of 5.5 mm to its maximum lift. First cam lobe 72 provides a lifting or locking action and bears against cam following block 36, forcing cam following block 36 upwardly, and forcing the bolt upwardly as well. Second cam lobe 74 provides a positive lowering or unlocking action when bearing against the lower substantially planar portion of the J shaped lower portion of each bolt. Second cam lobe 74 has a shorter duration with abrupt, symmetrical shoulders.

As best seen in FIGS. 4*a*-4*d*, cam following block 36 has at least one and preferably two blind bores 38, 40 configured to receive coil biasing springs 42, 44 (best seen in FIG. 6). Each cam following block 36 is fashioned as a rectangular box like shape having a length of approximately 8 mm, a width of 5.25 mm and a thickness of approximately 3 mm. The blind bores 38, 40 are preferably side by side and have a depth of 2 mm. Each cam following block's overall length is 9 mm, due to the axially projecting tongues 46, 48 dimensioned to slidably received in cooperating guiding grooves machined into the underside of each bolt 26, 28.

Each bolt, 26, 28 has, as best seen in FIG. 3*a*-3*e*, a substantially planar upper surface 80 defined within four substantially perpendicular side walls 82, 84, 86, 88, where two of the side walls correspond to the width of the bolt, 16 mm, and two correspond to the depth of the bolt, 5.25 mm, and together form a skirt-like support having a height of 7 mm. A "J" shaped actuating arm 90 depends from one of the short side walls 88 and extends downwardly below the bolt skirt depth. Actuating arm 90 is bent or radiussed in a gradual ninety degree bend to provide a bottom planar surface 92 extending substantially in parallel to bolt upper surface 80. Actuating arm 90 is substantially rectangular in cross section, having a depth of 3 mm and a thickness of 2 mm. Each bolt, 26, 28 has, as best seen in FIG. 3*a*-3*e* has a substantially rectangular recess defined within the sidewalls 82-88 to slidably receive cam following block 36, and has opposing parallel grooves dimensioned to receive and cooperate with cam following block tongues 46, 48, such that cam following block 36 can move up and down, compressing and releasing biasing force from captive biasing springs 42, 44 which are retained in the substantially rectangular recess within the bolt.

Each cam 32 preferably bears on a cam-following spring retaining block 36 which preferably includes first and second vertical blind bores 38, 40 containing first and second biasing coil springs 42, 44. As best seen in FIGS. 3*a*-3*e*, each bolt's "J" shaped actuating arm partially encircles cam 32 and the spring retaining block 36 is also disposed within the interior contour of the bolt (see FIG. 6).

Control screw 30 has a T-shaped distal handle 31 with an overall length of 22 mm and a width, in the handle's symmetrical extensions, of 4 mm, with rounded ends. The control screw distal end preferably also includes a slot and a hex socket for actuation by either a screw driver or a hexagonal section Allen™-style wrench. Control screw 30 preferably has a central shank portion having a key-shaped cross section adapted to carry and drive the first and second cams 32. In the illustrated embodiment of FIGS. 2*a*-2*e*, the shank has a substantially square cross section, 5.5 mm on a side, with chamfered corners, terminating proximally in a threaded cylindrical end adapted to receive and retain a threaded nut fastener.

Figure 1D:
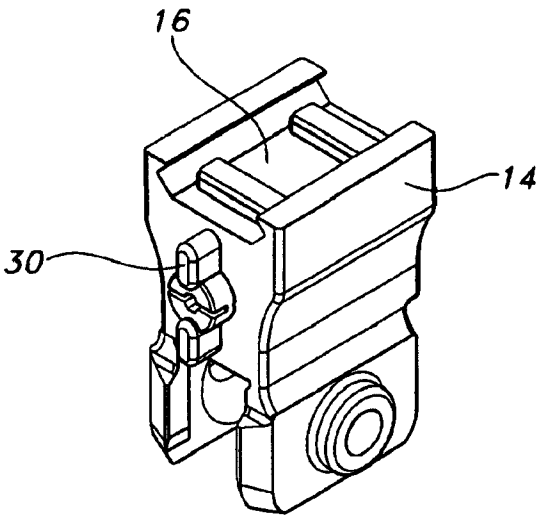
FIGS. 1*a*-1*d* illustrate a clamp assembly body showing the first and second transverse bolts in the raised, up, locked or closed position, in accordance with the present invention.
Figure 1C:
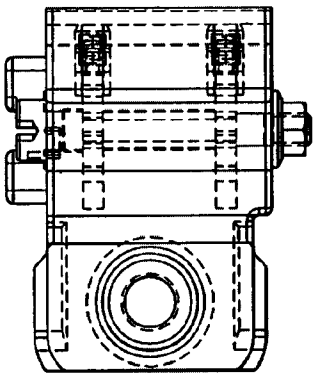
Figure 1B:
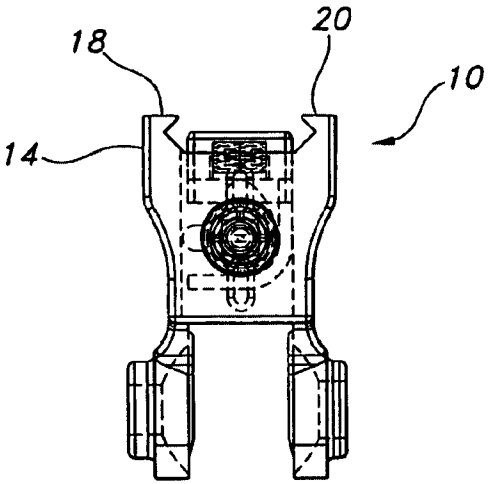
Figure 1A:
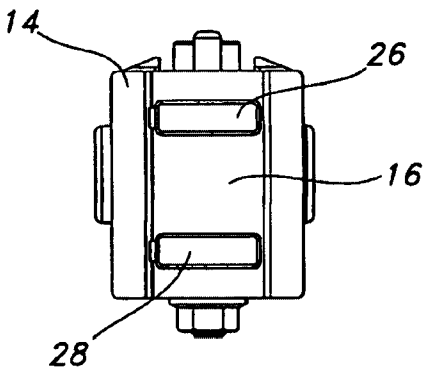
Figure 2E:
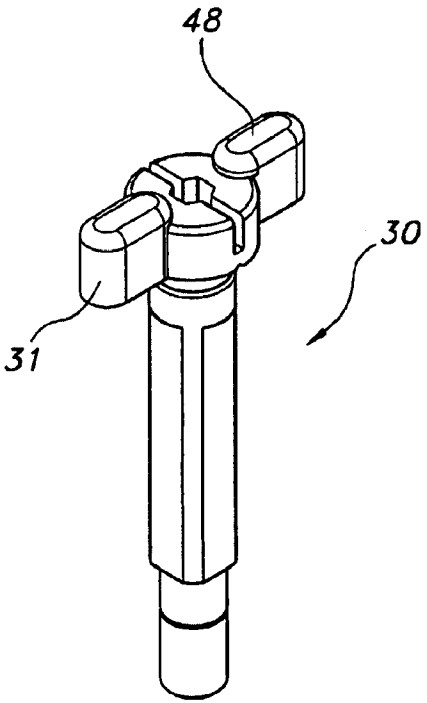
FIGS. 2*a*-2*e* illustrate the elongate control screw from the clamp assembly of FIGS. 1*a*-1*d*, in accordance with the present invention.
Figure 2D:
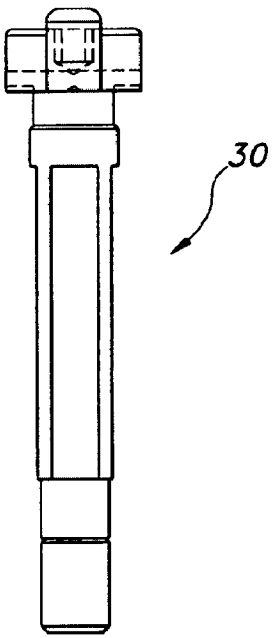
Figure 2C:
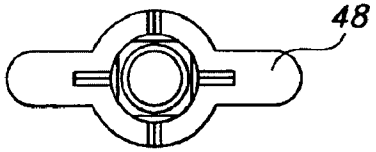
Figure 2B:
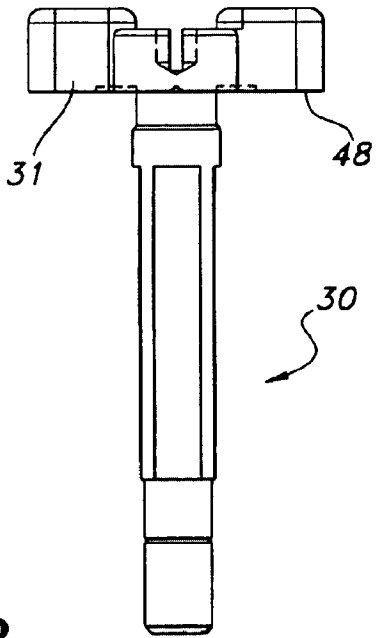
Figure 2A:
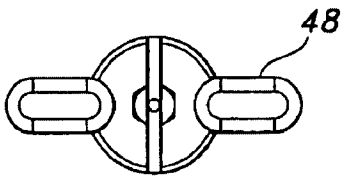
Figure 3E:
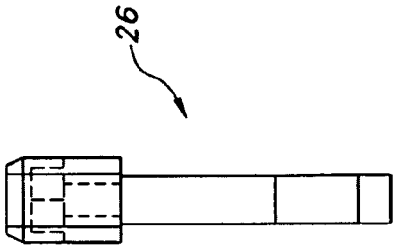
FIGS. 3*a*-3*e* illustrate a bolt from the clamp assembly of FIGS. 1*a*-1*d*, in accordance with the present invention.
Figure 3D:
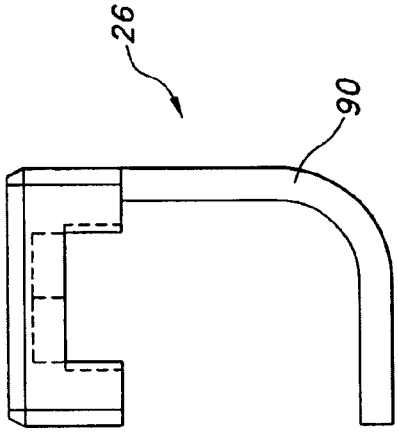
Figure 3C:
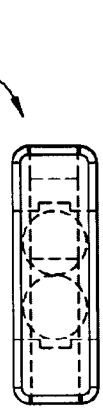
Figure 3B:
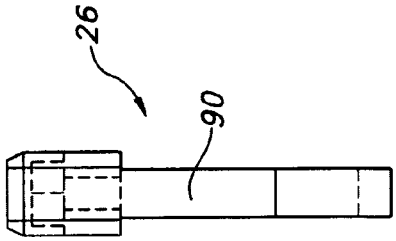
Figure 3A:
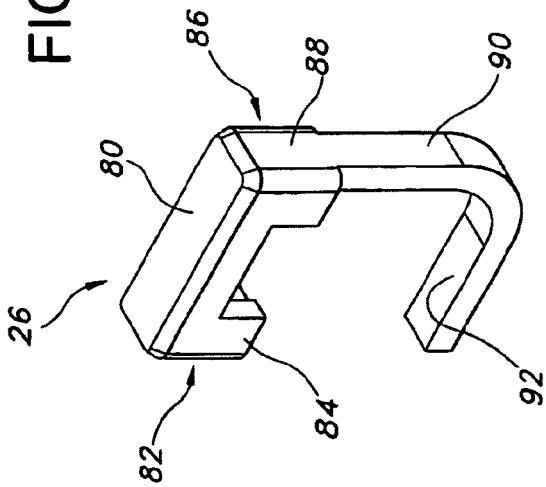
Figure 4D:
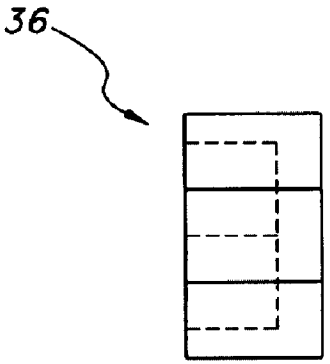
FIGS. 4*a*-4*d* illustrate a cam following spring retaining block from the clamp assembly of FIGS. 1*a*-1*d*, in accordance with the present invention.
Figure 4C:
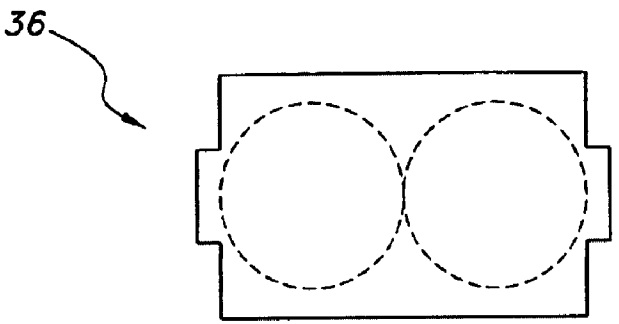
Figure 4B:
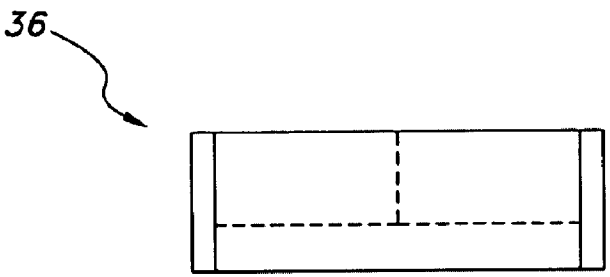
Figure 4A:
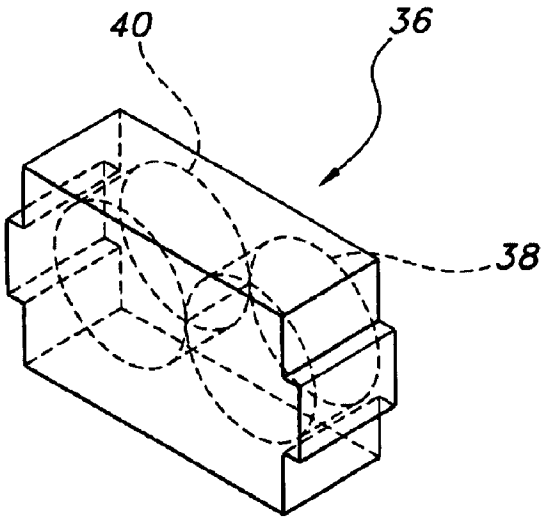
Figure 7D:
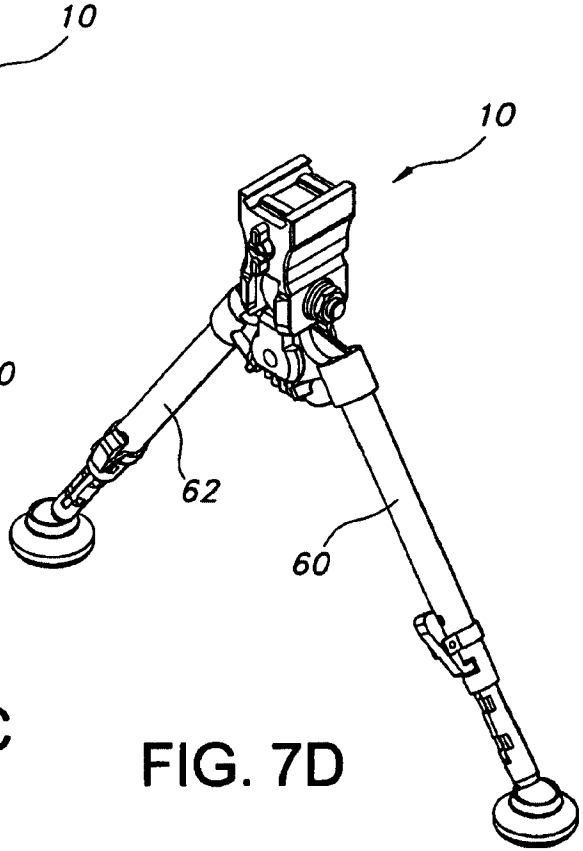
FIGS. 7*a*-7*d* illustrate the clamp assembly of FIGS. 1*a*-1*d* with an attached bipod having adjustable length legs and ball in socket swiveling or self leveling feet, in accordance with the present invention.
Figure 7C:
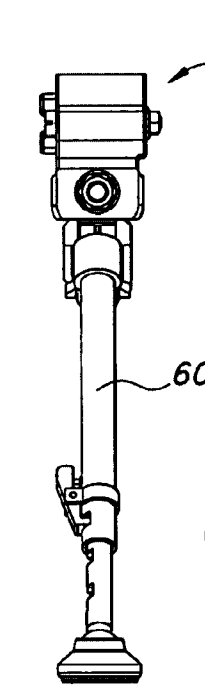
Figure 7B:
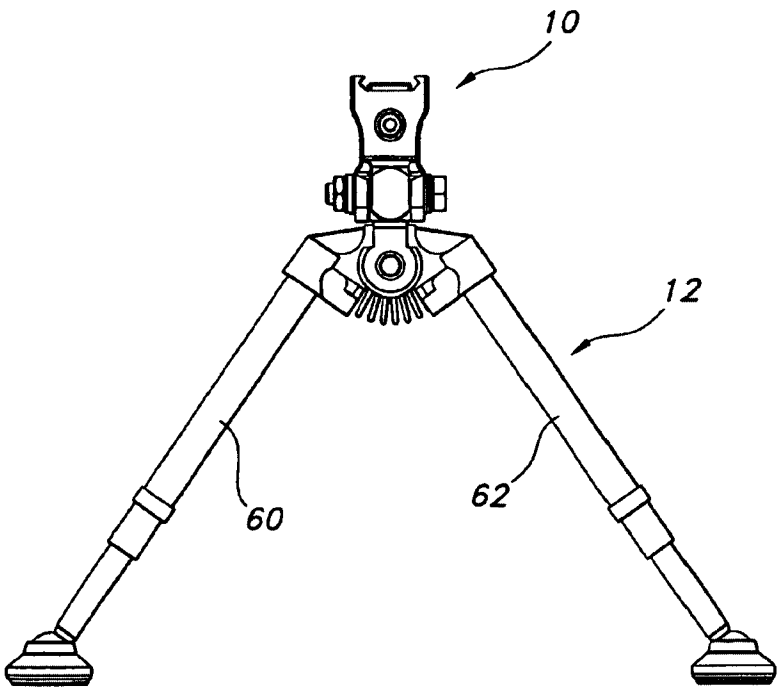
Figure 7A:
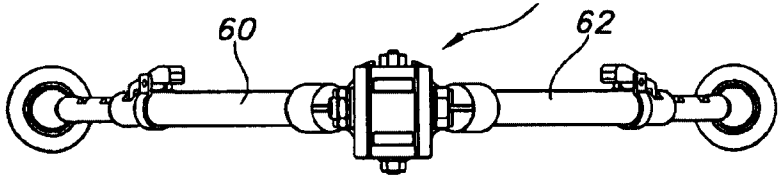
Figure 8:
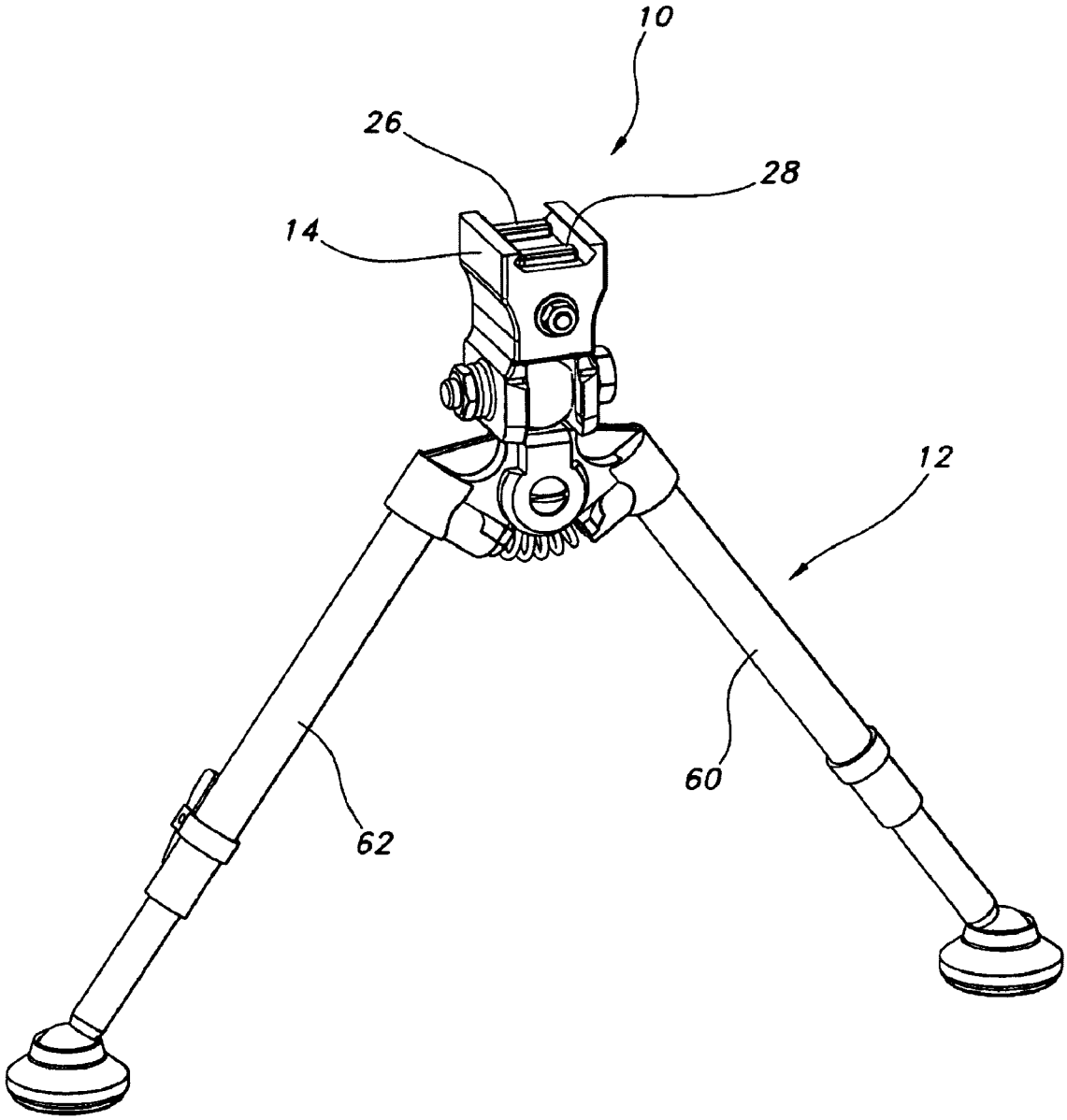
FIG. 8 illustrates the clamp assembly of FIGS. 1*a*-1*d* with the first and second bolts in the raised, up, locked or closed position, in accordance with the present invention.

When control screw 30 is turned counterclockwise in its longitudinal bore within clamp yoke 14, each cam 32 is rotated and its respective spring retaining block 36 is simultaneously urged up to simultaneously force both bolts into an upwardly projecting actuated or locked position (as in FIG. 8). Control screw 30 has a T-shaped distal handle 31 which is preferably in a vertical orientation when the bolts are in an actuated or locked position (as best seen in FIGS. 1*d* and 7*d*).

Figure 9:
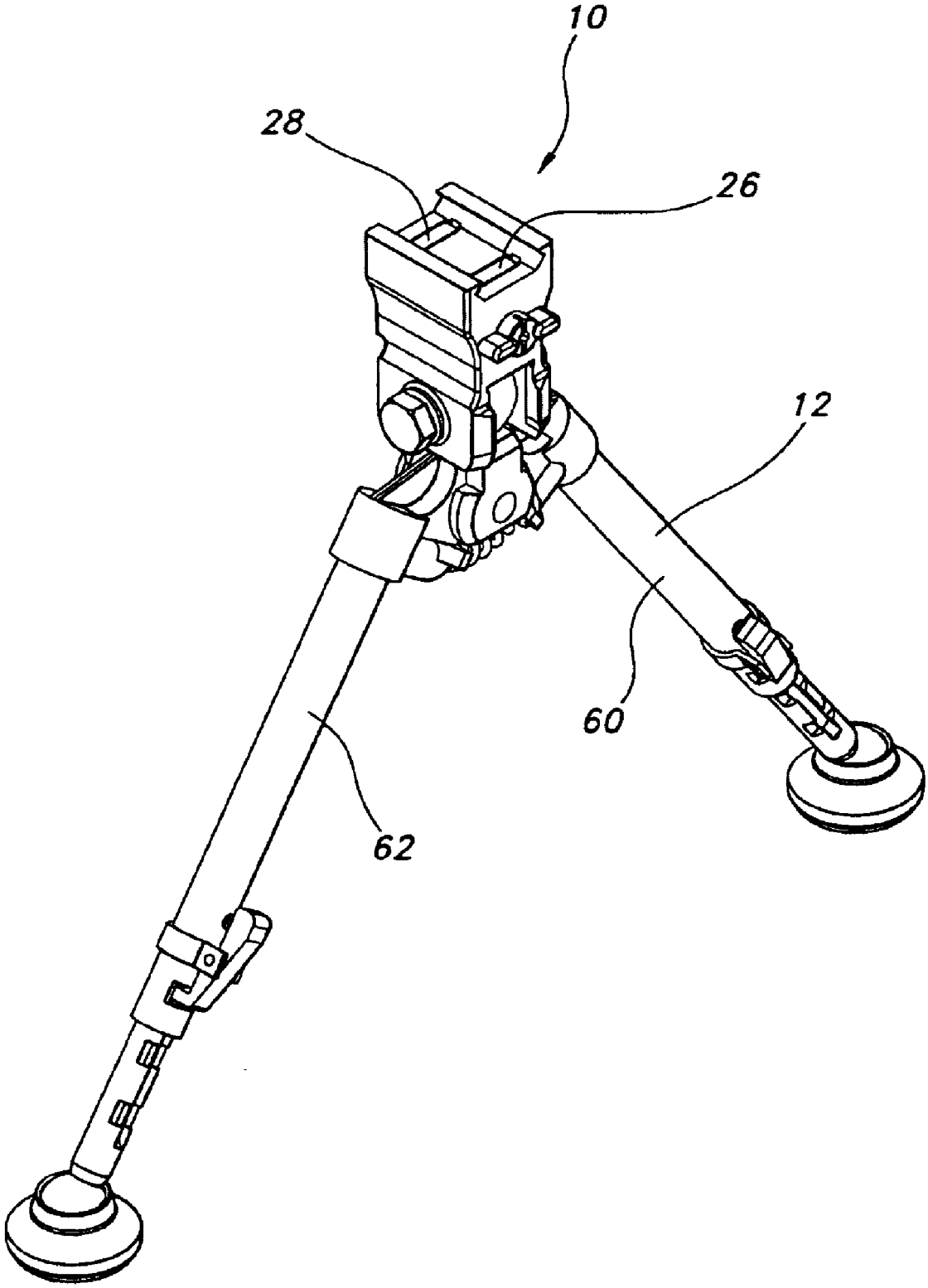
FIG. 9 illustrates the clamp assembly of FIGS. 1*a*-1*d* and 8 with the first and second bolts in the retracted, down, unlocked or open position, in accordance with the present invention.

When control screw 30 is turned clockwise, by ninety degrees, in its longitudinal bore within clamp yoke 14, each cam 32 is rotated into a position tending to simultaneously positively force the bolts downwardly by acting on bolt actuating arm 90, at bottom planar surface 92 to lower the bolts 26, 28 such that the bolt's upper surfaces 80 do not project above the yoke base plate's central upper surface 16 (as in FIG. 9). Control screw 30 has a T-shaped distal handle 31 which is preferably in a horizontal orientation when the bolts are in the unlocked, down or retracted position (as best seen in FIGS. 1*d* and 7*d*).

In use, the bolts 26, 28 are initially in the unlocked, down or retracted position, such that neither bolt projects above the yoke base plate's central upper surface 16 (as in FIG. 9). To install the clamp assembly 10 on support rail 50, as shown in FIG. 10, the user or shooter slides the clamp assembly's yoke 14 over the free distal or proximal end 56 of rail 50 and places the clamp assembly 10 in a selected aligned fore/aft position. Next, the clamp assembly's control screw 30 is rotated or twisted by grasping the control screw's T-shaped handle segment 31, thereby simultaneously rotating cams 32, 34 and forcing first and second transverse bolts 26, 28 to the raised, closed or locked position, whereupon bolts 26, 28 are received in and constrained by the spaced apart transverse grooves 52, 54 of support rail 50 to fixedly attach yoke 14 to rail 50.

Alternatively, support rail 50 could have a line of apertures (not shown) sized to receive at least one bolt, and the yoke sidewalls could be dimensioned to slidably partially encircle the cross-sectional periphery of a support having a different cross section than the rail of the illustrative embodiment.

The resulting attachment of the clamp assembly 10 to the forearm stock provides a quick and easy attachment of the bipod (or some other accessory) to the firearm (or some other instrument) and enables the clamp assembly to mount securely to the forearm stock of the firearm in a stable, secure selected position. This prevents the clamp assembly 10, and thus the accessory carried by the clamp (e.g., bipod 12), from shifting fore and aft or wobbling during use.

With clamp assembly 10 securely mounted to the forearm stock of the firearm, the attached accessory (e.g., bipod 12) is placed in locking engagement with the firearm. Optionally, a detachable sling loop (not shown) can be provided with the clamp assembly for attachment of a rifle sling to the stock of the firearm.

As noted above, mounting yoke 14 defines a substantially U-shaped block having inwardly facing opposing V-shaped grooves in vertical sidewalls 18, 20 and is preferably formed from a hardened metal such as steel or similar durable, high-strength material. The side walls 37 and 38 are spaced apart at a distance sufficient to slidably receive the rail and limit lateral movement. Bolts 26, 28 function as transverse fasteners and, when in the rail's transverse grooves 52, 54, provide substantially square cross section elongate retaining members that are received through clamp body bores 22, 24 in the base plate surface 16 of mounting yoke 14 and through the aligned transverse grooves of the picatinny rail, thereby limiting fore and aft movement of clamp assembly axially along the axis of the supporting picatinny rail.

It will be appreciated that FIG. 6 illustrates an exploded perspective view of a clamp assembly 10 embodying the principles of this invention. Yoke 14 has mirror image upstanding sides or sidewalls 18, 20 that project from base plate surface 16, also referred to as a bight portion or floor.

In use, to quickly attach the clamp assembly, the user first twists the control screw handle 31 to lower the bolts 26, 28 and then slides yoke 14 over the proximal or distal end of the mounting rail (secured to the forearm stock) and slides yoke 14 into a selected fore/aft position, aligning a selected support rail transverse groove with bolts 26, 28. The bolts may then be raised or locked into engagement with the receiving transverse grooves defined in the picatinny rail to secure the picatinny rail within the yoke 14. To quickly and easily release the clamp assembly, the user then twists the control screw handle to lower the bolts 26, 28 into a disengaged or unlocked position and then slides yoke 14 over and beyond the proximal or distal end of the mounting rail.

If needed, a bipod 12 is received and mounted to the clamp body; the bipod legs can be folded into a raised non-operative position when not in use, and can quickly be lowered to an operative, ground engaging position when needed.

It will be understood that while the foregoing relates to a preferred embodiment of the present invention, various modifications, additions and changes may be made thereto without departing from the spirit and scope of the invention as set forth in the claims.

Further, it will be understood by those skilled in the art that while the present invention has been disclosed for use primarily with the Parker-Hale bipod assembly, the present invention also can be used for mounting the types of bipods having a bipod leg frame that is releasably mountable to a mounting block for a firearm.

What is claimed is:

1. An accessory mount adapted for releasable attachment to an elongated rail having V shaped sides and a plurality of evenly spaced transverse notches or grooves, comprising:

a clamp body with a mounting yoke that is adapted to slide over and receive the opposing V shaped sides of the rail;

said yoke including a substantially rectangular base plate surface defining a central upper surface of said clamp body and including a pair of parallel sidewalls extending upwardly therefrom;

said base plate being a substantially flat plate-like surface having first and second elongate transverse openings or bores formed across a centerline of the rectangular base plate's central upper surface;

said clamp body including first and second substantially upwardly movable bolts slidably disposed within first and second elongate transverse openings in the rectangular base plate's central upper surface;

said movable bolts being actuable to project upwardly from the yoke base plate's central upper surface.

2. The accessory mount of claim 1, wherein said yoke base plate sidewalls include inwardly facing v-shaped grooves and are spaced apart;

said sidewalls being adapted to slidably retain and straddle the V shaped sides of the rail when mounted to a forearm stock of a firearm, with the length of the rail being received between the side walls.

3. The accessory mount of claim 2, wherein said rail comprises a picatinny rail on a firearm.

4. The accessory mount of claim 1, wherein said clamp body's first and second transverse bolts, when raised and aligned with the transverse grooves of the rail, are received in the spaced transverse grooves of the rail to affix said yoke said rail.

5. The accessory mount of claim 4, wherein said clamp body's first and second transverse bolts engage alternate rail grooves, leaving one rail groove not engaged between the bolts.

6. The accessory mount of claim 1, wherein said bolts are actuated by turning an elongate control screw keyed to turn first and second substantially identical eccentric rotating cam members within the clamp body and beneath the first and second bolts.

7. The accessory mount of claim 6, wherein each cam has at least one cam lobe bearing on a cam-following spring retaining block which includes first and second vertical blind bores containing first and second biasing coil springs.

8. The accessory mount of claim 7, wherein each bolt includes a J shaped member with the cam and spring retaining block disposed within the interior contour of the bolt, such that the cams and their respective spring retaining blocks are simultaneously rotated when said control screw is turned in its bore within the clamp body to urge the cams to simultaneously force both bolts into an upwardly projecting position.

9. The accessory mount of claim 8, wherein each cam is rotatable to bear downwardly on said bolt actuating arms to simultaneously force the bolts downwardly, to lower the bolts such that the bolts do not project above the yoke base plate's central upper surface.

10. A method for attaching a clamp assembly to a support rail having V shaped sides and a proximal or distal end, comprising the steps of:

(a) providing an clamp assembly having a clamp body with a mounting yoke that is adapted to slide over and receive the opposing V shaped sides of the rail; said yoke including a substantially rectangular base plate surface defining a central upper surface of said clamp body and including a pair of parallel sidewalls extending upwardly therefrom; said base plate being a substantially flat plate-like surface having first and second elongate transverse openings or bores formed across a centerline of the rectangular base plate's central upper surface; said clamp body including first and second substantially upwardly movable bolts slidably disposed within first and second elongate transverse openings in the rectangular base plate's central upper surface; said movable bolts being actuable to project upwardly from the yoke base plate's central upper surface in response to actuation of a control;

(b) actuating said control to move said bolts into a retracted position;

(c) sliding said yoke over said rail end and along the axis of the rail to a selected position;

(d) actuating said control to raise said bolts and lock said yoke into engagement with the transverse grooves defined in the rail.

* * * * *